United States Patent [19]

LaScola

[11] 4,095,067

[45] June 13, 1978

[54] APPLIANCE SWITCH

[75] Inventor: Anthony Rosario LaScola, Bellingham, Mass.

[73] Assignee: Ark-Les Switch Corporation, Watertown, Mass.

[21] Appl. No.: 778,101

[22] Filed: Mar. 16, 1977

[51] Int. Cl.[2] ..... H01H 13/28

[52] U.S. Cl. ..... 200/67 AA; 200/310; 200/317; 200/335

[58] Field of Search ..... 240/25; 200/310, 317, 200/315, 67 AA, 67 A, 335, 339

[56] References Cited

U.S. PATENT DOCUMENTS

| | | | |
|---|---|---|---|
| 1,935,498 | 11/1933 | Bentley | 200/67 A X |
| 1,971,212 | 8/1934 | DeReamer et al. | 200/67 AA |
| 3,309,485 | 3/1967 | Gluck | 200/317 |
| 3,327,078 | 6/1967 | Sorenson | 200/67 AA |
| 3,328,551 | 6/1967 | Schlitt et al. | 200/310 |
| 3,542,975 | 11/1970 | Walterick | 200/67 AA |
| 3,872,269 | 3/1975 | Schneider | 200/67 AA |
| 3,965,319 | 6/1976 | Lockard | 200/310 |

FOREIGN PATENT DOCUMENTS

| | | | |
|---|---|---|---|
| 924,008 | 4/1963 | United Kingdom | 200/67 AA |

*Primary Examiner*—J. V. Truhe
*Assistant Examiner*—M. Paschall

[57] ABSTRACT

A snap-action appliance switch, whose construction meets European safety standards as well as U.S. (Underwriters Laboratory) standards.

4 Claims, 10 Drawing Figures

FIG 2
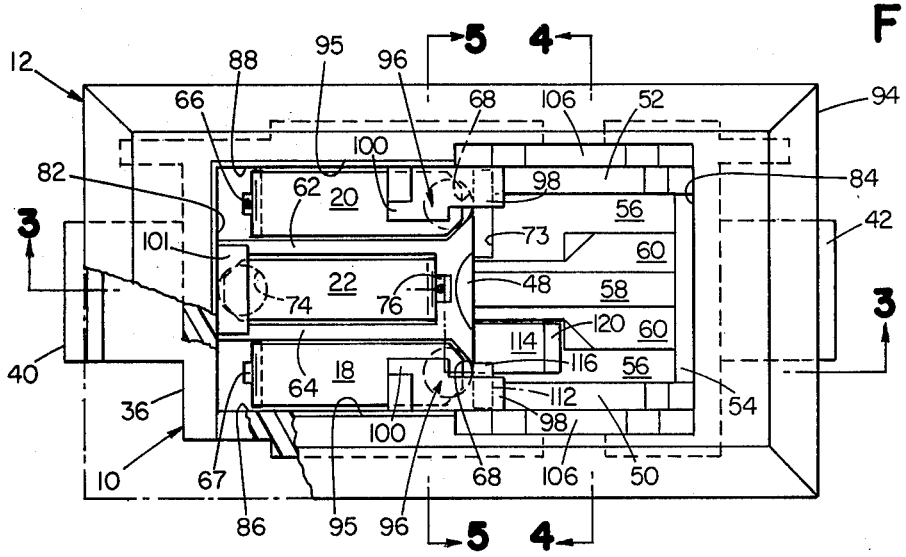
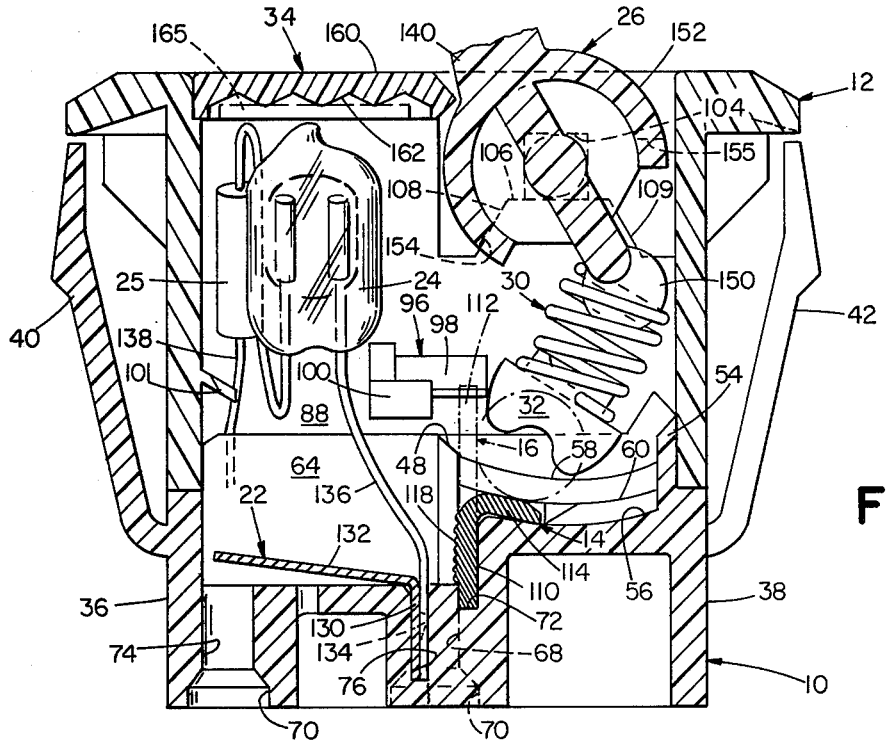
FIG 3
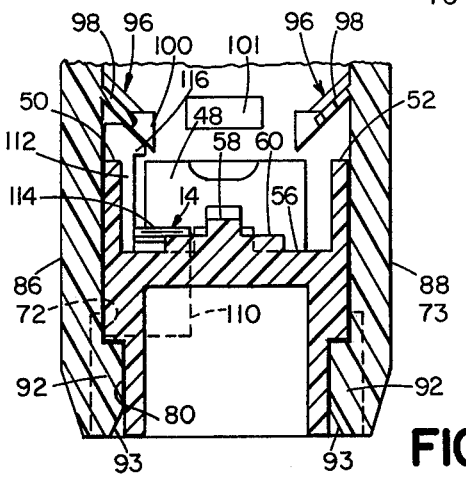
FIG 4
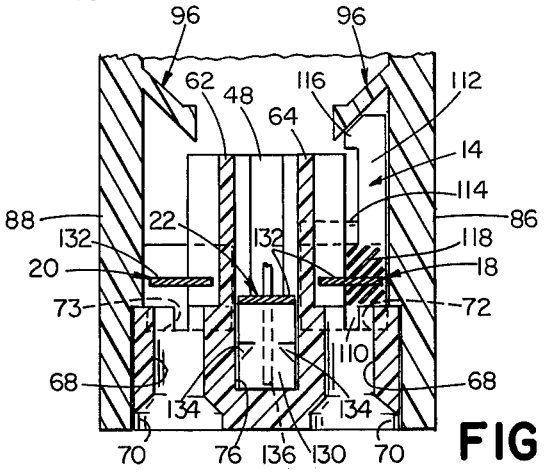
FIG 5

APPLIANCE SWITCH

This invention relates to an electrical switch. In particular, it relates to a snap-action appliance switch, whose construction meets European safety standards as well as U.S. (Underwriters Laboratory) standards.

Appliances such as coffee making machines, having burners that remain hot so long as the machine is turned on, desirably employ switches that include an indicator lamp, wired to be illuminated when the circuit including the power source is closed, thereby giving warning that the burner is on, and to be dark when the circuit is open. Since the appliances may be intended for sale both in the U.S. and abroad, it is necessary that such a switch meet European safety standards as well as the standards of Underwriters Laboratory, used in the U.S. Specifically, such standards require the spacing between the electrical contacts in the open circuit condition to be at least as great as a standard value. The U.S. standard is 3/64 inch (about 0.047 inch), while the European standard, as required by the International Commission on Rules for the Approval of Electrical Equipment (CEE), in their publication on "Specifications for switches for appliances," published in October, 1962, is 3 mm (about 0.118 inch). Thus a switch that meets the European standard will also satisfy the less strict U.S. standard and appliances using the switch can be sold in either country.

However, requirements for economy of both materials and space make it difficult to design a switch that meets the safety standards while still being inexpensive and compact. Such switches typically receive hard wear in an atmosphere of warm moisture and steam, and must be reliable under such use.

It is therefore an object of this invention to provide an appliance switch that meets the European as well as the U.S. safety standards, while being inexpensive to make, compact in design, and reliable in heavy use.

FIG. 2 is a plan view, partially broken away, of a portion of the assembled switch omitting certain portions for clarity;

FIG. 3 is a longitudinal sectional view taken on the line 3—3 of FIG. 2;

Figure 8:
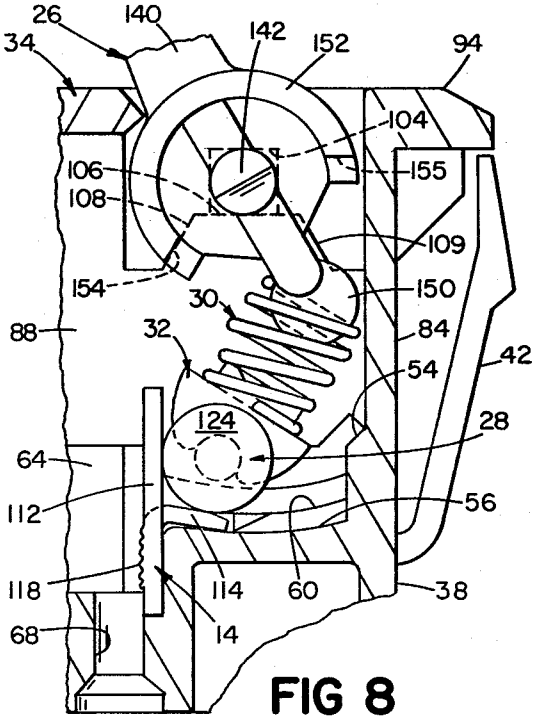
Figure 7:
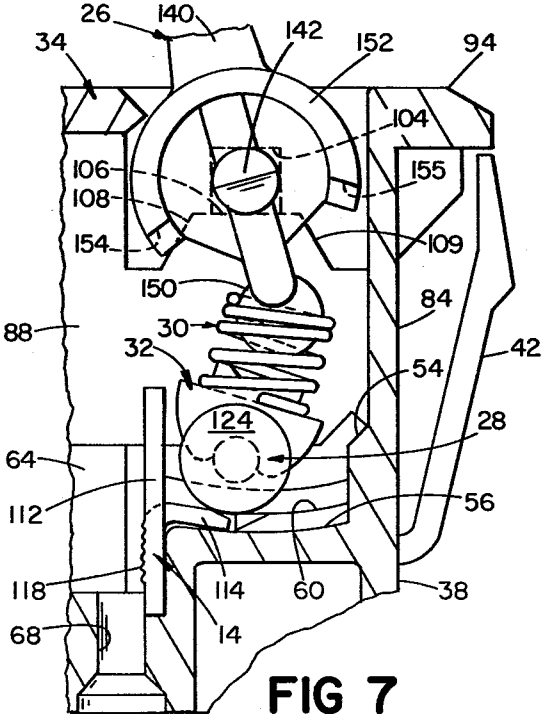
Figure 6:
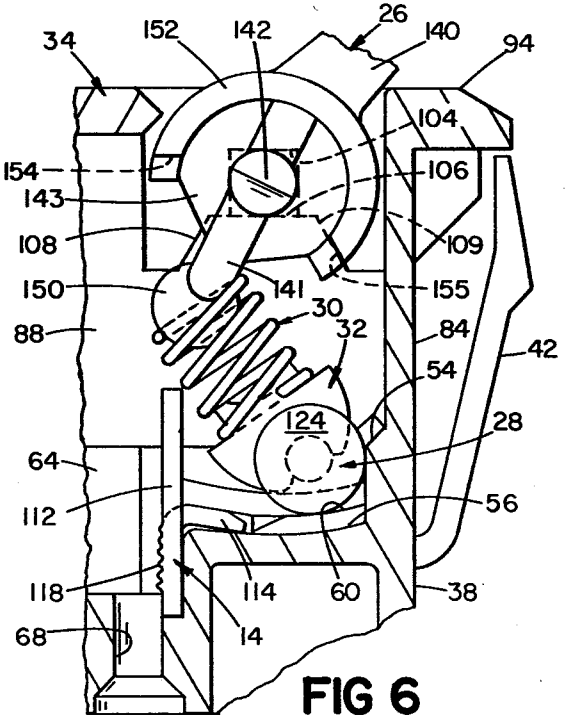
Figure 9:
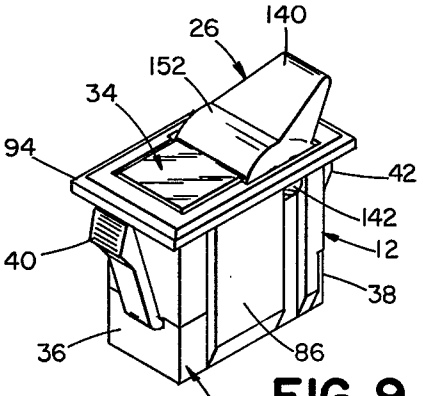

FIGS. 4 and 5 are cross sectional views taken on the lines 4—4 and 5—5 respectively of FIG. 2;

FIGS. 6, 7 and 8 show three successive stages of operation of the switch;

FIG. 9 shows the exterior of the assembled switch; and

Figure 10:
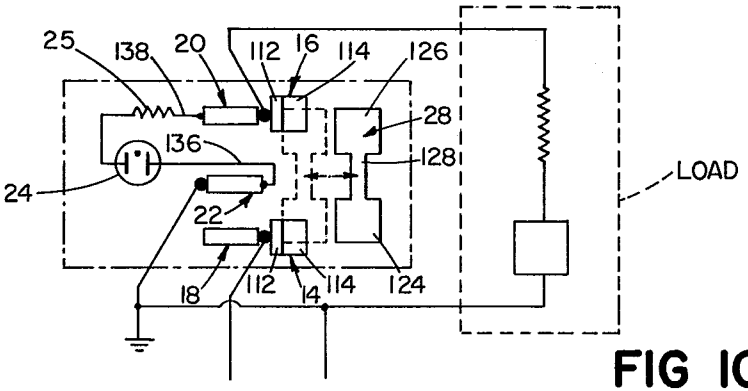

FIG. 10 is a diagramatic view of the circuit of the switch.

Figure 1:
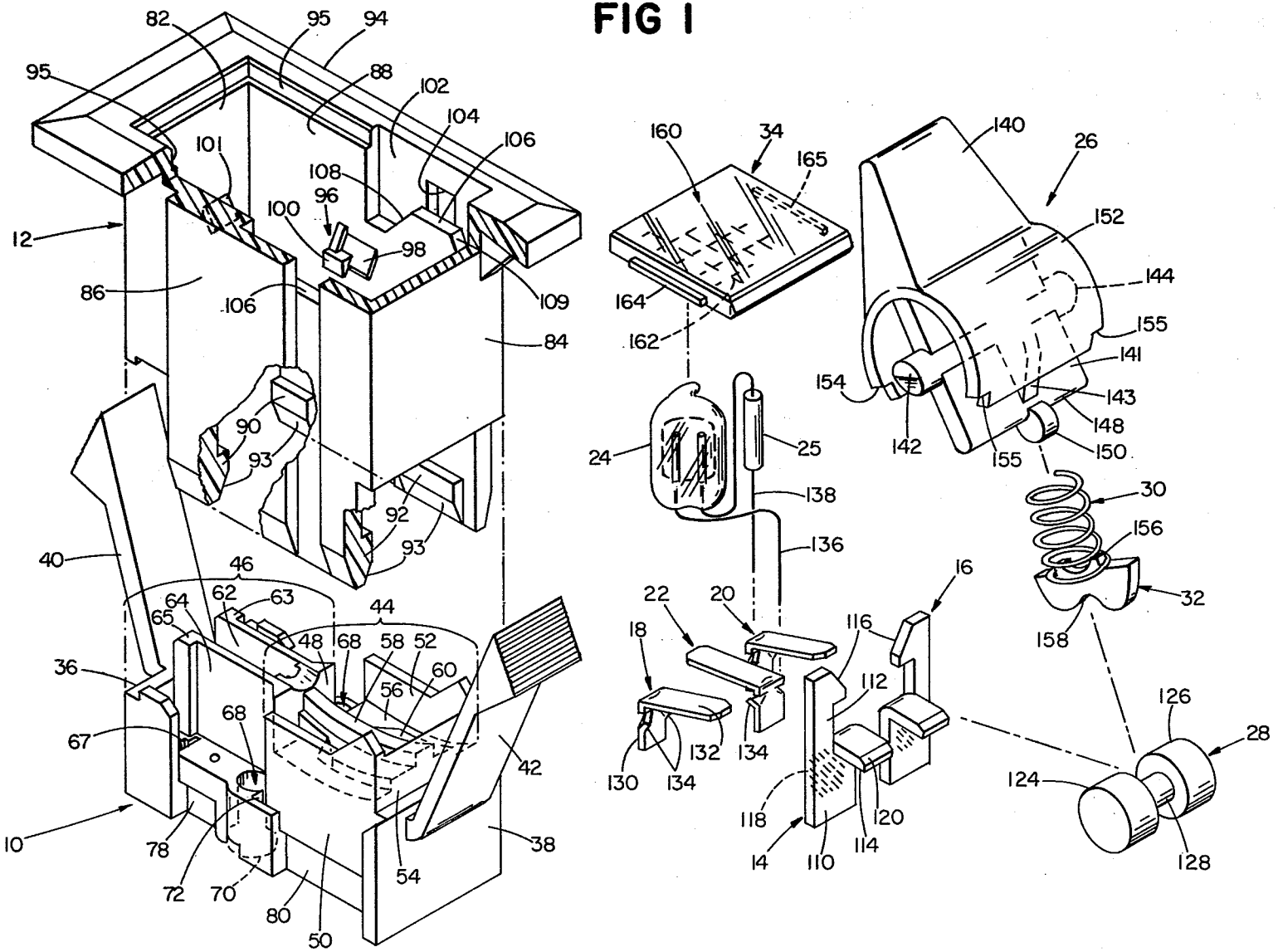
FIG. 1 is an exploded view of the components of the switch of the invention.

Referring to the drawings, and particularly to FIG. 1, a particular 15 amp switch according to the invention has a base 10 and a case 12 that snap together to assemble the switch. Two fixed contacts 14 and 16 are secured to base 10. Contact springs 18 and 20 are fixed in base 10 in positions to retain inserted wires for connection to fixed contacts 14 and 16, as will be explained. A third contact spring 22 is provided for the lamp circuit, as will be described. A neon lamp 24 is connected between contact springs 20 and 22.

A paddle actuator 26 is pivotably fixed in case 12. A roller contact 28 is movable to make and break the circuit through fixed contacts 14 and 16. Roller contact 28 is moved by paddle actuator 26 through spring 30 and guide 32, which provide a snap action, as will be explained. A colored translucent lens 34 is provided in case 12, through which lamp 24 is seen to be illuminated or not, according to the condition of the switch.

More in detail, case 12 and base 10 are molded of an insulating material, preferably type 66 nylon.

Base 10 provides end walls 36 and 38, with integrally formed resilient retaining wings 40 and 42 supported thereon. Retaining wings 40 and 42 aid in retaining the switch in position with respect to a mounting surface such as a panel, not shown, in the end environment of the assembled switch. The interior of base 10 is divided generally by transverse wall element 48 into a roller contact track portion 44 adjacent end wall 38 and a contact spring retaining portion 46 adjacent end wall 36.

Track portion 44 is defined by side walls 50 and 52, transverse wall element 48, and roller stop wall 54, which is spaced inwardly of base end wall 38. Within these walls is track floor 56, which provides a raised roller guide 58 extending between transverse wall element 48 and stop wall 54. The upper surface of roller guide 58 is slightly concave upwardly from track floor 56, to correspond with the curved path of roller contact 28 as moved by the pivoting actuator 26. On either side of roller guide 58 is a contact spacer portion 60, extending from transverse wall element 48 to roller stop wall 54 and being narrowed adjacent transverse wall element 48 to accommodate the fixed contact elements, as will be described. The upper surface of each contact spacer portion 60 is intermediate in height between track floor 56 and the upper surface of roller guide 58, and parallels the concave outline of roller guide 58.

The width of roller guide 58 is 0.062 inch; its height above the upper surface of contact spacer portion 60 is 0.034 inch; the width of contact spacer portion 60 in its narrowed portion is 0.020 inch.

Contact spring retaining portion 46 of base 10 is divided into three parallel and generally similar contact spring areas by inner vertical walls 62 and 64 extending between transverse wall portion 48 and column portions 63 and 65 respectively. Each of the two outer areas has a contact spring receiving slot 66, 67 adjacent the respective column portion, and a wire aperture 68, 69 adjacent transverse wall element 48, extending entirely through base 10 and a countersunk at the bottom surface thereof as indicated in phantom at 70 (FIG. 1). Each vertical wall 62, 64 extends 0.160 inch above the contact spring receiving slot, and is 0.025 inch thick. A fixed contact receiving slot 72 is provided tangent to wire aperture 68 and adjacent to base track portion 44. The area of tangency (permitting electrical contact between the inserted wire and the fixed contact) is seen at 71 in FIG. 5. A similar fixed contact receiving slot 73 (FIG. 2) is provided beyond inner wall 62, but is not visible in FIG. 1.

The middle contact spring area is reversed in orientation with respect to the two outer areas, having a wire aperture 74 (not visible in FIG. 1 but best seen in FIG. 2) adjacent base end wall 36 and countersunk at the bottom surface of base 10, and a contact spring receiving slot 76 adjacent transverse wall element 48. This arrangement provides maximum spacing between adjacent contact springs, as will be described.

Base 10 is relieved at portions 78 and 80 adjacent its lower edge, for cooperation with bosses on case 12, to be described, to secure the base and case together in assembling the switch. Relieved portions corresponding to portions 78 and 80 are provided on the opposite edge of base 10, not visible in FIG. 1.

Case 12 provides end walls 82 and 84, whose outer surfaces are generally continuous with the outer surfaces of base end walls 36 and 38 in the assembled switch. Case 12 further provides side walls 86 and 88, having on their inside surfaces, adjacent the lower edge, bosses 90 and 92, which cooperate with relieved portions 78 and 80 respectively of base 10 to secure the assembled switch together. Bosses 90 and 92 are each beveled at 93 for ease in assembling the switch. The upper edge of case 12 provides a beveled frame 94. Grooves 95 are provided in side walls 86 and 88 adjacent frame 94 to receive lens 34.

The inner surface of each side wall 86, 88 provides an ear 96, which includes a relatively flexible contact retaining portion 98 and a relatively stiff wire stop portion 100. End wall 82 provides a wire stop 101, indicated in FIG. 1.

When the switch is assembled, ear 96 is vertically aligned with the base so that wire stop portion 100 cooperates with wire aperture 68 to limit the insertion of a wire, and contact retaining portion 98 cooperates with a slot 72 to retain a fixed contact locked into position against displacement when the wire is inserted. Wire stop 101 cooperates with wire aperture 74 (FIG. 3) to limit the insertion of a third wire.

The inner surface of case side wall 99 is relieved at 102 adjacent frame 94, and this area is provided with a pivot aperture 104 extending through wall 88. A pivot support surface 106 is provided immediately below aperture 104, and angled stop surfaces 108 and 109 are provided to either side of support surface 106.

Fixed contacts 14 and 16 are made of copper, silver-plated. Each fixed contact has a vertical base portion 110, a vertical connector portion 112 integral with base portion 110, and a generally horizontal extending portion 114, having a slight (15°) downward slope away from the main body of fixed connector 14. Base portion 110 of contact 14 is received in contact receiving slot 72 of base 10. When fixed contact 14 is assembled to base 10, extending portion 114 overlies track floor 56 adjacent the narrowed part of contact spacer portion 60. The upper surface of contact extending portion 114 is generally parallel with but slightly higher than the upper surface of contact spacer portion 60, and thus below the level of roller guide 58.

Vertical connector portion 112 has an angled inner edge surface 116 which cooperates with contact retaining portion 98 of case ear 96 when the switch is assembled to retain fixed contact 14 in its correct position, as seen, for example, in FIG. 4. The upper leading edge of extending portion 114 is coined at 120 to remove any sharp edges that might cause roller 28 to hang up. The back surface of contact 14, that is, the surface spaced from the extending portion 114, is provided with a plurality of serrations, indicated at 118 in FIG. 5, at an angle of 45° to the vertical. These serrations aid in providing good electrical contact with the plug-in wire, to be inserted through wire aperture 68, for connection to fixed contact 14 when the switch is in use.

Fixed contact 16 is a mirror image of fixed contact 14, and its base is received in contact receiving slot 73, corresponding to slot 72.

Roller contact 28 is made of silver-plated copper alloy, and has a generally dumb-bell shape, having two outer roller elements 126 joined by a narrower guide track follower portion 128.

Contact springs 18, 20 and 22 are generally similar to one another. Each is made of spring tempered steel and has a generally vertical base portion 130 and a generally horizontally extending spring portion 132 slightly inclined (7°) upwardly from the horizontal. Each base portion 130 provides two retaining ears 134, which maintain the spring in position in its contact spring receiving slot in switch base 10.

Neon lamp 24 is connected in series with a 47,000 ohm resistor 25; lead 136 from the lamp is inserted with spring 22 into contact spring receiving slot 76 of base 10, and lead 138 from the resistor is inserted with spring 20 into contact spring receiving slot 66 of base 10.

Paddle actuator 26 includes a tapered paddle 140, extending beyond case frame 94 in the assembled switch for manual actuation of the switch. Actuator 26 provides a downwardly extending generally flat projection 141, carrying two pivot ears 142 and 144. The lower edge 148 of projection 141 carries a generally cylindrical spring positioner 150. Projection 141 is strengthened by two rib portions 143, tapered toward positioner 150. Actuator 26 further provides a closure element 152 of generally cylindrical surface, convex to the switch exterior, and providing cut out edge portions 154 and 155 that function as actuator stops in cooperation with stop surfaces 108 and 109 of case 12. The axis of actuator paddle 140 is inclined at an angle of about 10° to the axis of projection 141.

Guide 32, made of an insulating material such as laminated stamped paper-based phenolic board, has a neck portion 156 that fits closely within the lowest coil of spring 30, and a roller engaging surface 158 that engages guide follower 128 of roller 28.

Lens 34 is made of a colored translucent material, and has a smooth upper surface 160 beveled at the outer edges, and an under surface 162 that is cross-grooved to provide a light-diffusing effect. Lens 34 provides bosses 164 on opposite edges, for cooperation with case grooves 95 in assembly of the switch.

The exterior of the assembled switch is seen in FIG. 9. In assmebly, lead 138 from lamp resistor 25 is inserted together with contact spring 20 into slot 66. Lead 136 from lamp 24 is inserted together with contact spring 22 into slot 76. Contact spring 18 is inserted into slot 67. The three contact springs are maintained in position by retaining ears 134. Fixed contacts 14 and 16 are inserted into slots 72 and 73. Case 12 is snapped onto base 10. Roller 28 is placed in track portion 44. Spring 30 is fixed to the neck 156 of guide 32, and the other end of spring 30 is placed around paddle positioner 150. Paddle 26 is secured in case 12 by snapping pivot ears 142 and 144 into pivot apertures 104, at the same time positioning surface 156 of guide 32 over follower surface 128 of roller 28. Finally, lens 34 is snapped into position in frame 94 by means of bosses 164 and grooves 95.

In the assembled switch, before it is connected for use, the path from the uppermost portion of a contact spring, over the intervening inner vertical wall (62 or 64) to the adjacent contact spring, is considerably greater than 3.0 mm, is required by the European safety standards. In part, this as achieved by alternating the orientation of the three contact springs. The elevated free end of each spring is side by side with the lower portion of each neighboring spring, adjacent the contact spring base portion 130 fixed in switch base 10. In use, however, when the connecting wires of the power source and appliance load are pushed through the apertures, the free ends of contact springs 18, 20 and 22 are pushed upwardly and the inserted wire may extend as far as the respective retaining ear. In order to maintain the necessary gap between the wire and the neighboring spring, the height of walls 62 and 64 is made greater than the nominal standard dimension.

In operation, as seen in FIGS. 6, 7 and 9, the switch is in an OFF condition (FIG. 6) when roller contact 28 is maintained against roller stop surface 54 of base 10. Actuator stop 155 rests against case stop surface 109.

In the OFF condition of the switch, the shortest distance from a fixed contact extending portion 114 to the nearest roller element 126 is 1.5 mm. There are two distances of 1.5 mm, one between each fixed contact and its nearest roller element; the total distance is therefore 3.0 mm, as required by European safety standards. When the switch is turned on by moving paddle 140, roller 28 does not move until actuator stop 154 has almost reached stop surface 108. Roller contact 28 is then abruptly moved away from roller stop wall 54 toward fixed contacts 14 and 16.

As seen in FIG. 7, the initial point of contact between a roller 126 and the corresponding fixed contact 14 is on extending portion 114 of the fixed contact. However, spring 30 continues to urge paddle 26 forward until actuator stop 154 contacts stop surface 108. Roller contact 28 is thereby moved further along the track until roller 126 comes into contact with fixed contact vertical connector portion 112, as seen in FIG. 8. Because of this, any carbon buildup resulting from arcing occurs on extending portion 114, while the surface of vertical portion 112 remains clean, permitting repeated good contacts to be made during the lifetime of the switch.

The switch of the invention is designed for use with push-in wires, to be inserted by the end user, rather than being manufactured with wire connections ending in metal terminals; the switch is therefore economical to manufacture and to use, since the end user need not equip the wires of his appliance with corresponding terminals.

What is claimed is:

1. A compact snap-action appliance switch comprising an insulating base, an insulating case adapted for assembly to said base, two fixed contacts carried in said base, a paddle actuator movable in said case, and a roller contact movable by said actuator, said insulating base having a generally vertical wall element extending upwardly from said base and defining a base roller contact track portion and a further portion said track portion having a roller stop wall generally parallel with said wall element side walls connecting said roller stop wall and said wall element a track floor bounded by said walls and said wall element and having a raised roller guide extending between said wall element and said roller stop wall, contact spacer portions on either side of said roller quide, each said spacer portion extending lengthwise generally parallel with said guide between said wall element and said roller stop wall, each said spacer portion extending widthwise from said roller guide toward the adjacent said side wall and having a narrower widthwise extension adjacent said wall element than adjacent said roller stop wall, the upper surface of a said spacer portion being intermediate in height between said track floor and said roller guide upper surface, said track floor, said roller guide upper surface, and said contact spacer portion upper surfaces being generally concave upwardly with respect to said base, said further portion having wire apertures adjacent said wall element, extending entirely through said base, and wire retaining means adjacent thereto and cooperating with said fixed contacts and said case to retain a wire for electrical contact, said insulating case having wire stop means carried on the inner surfaces of said case and positioned for cooperation with said base wire apertures, each said fixed contact having a vertical base portion, a vertical connector portion integral therewith and extending above said base portion, and a generally horizontal extending portion declined slightly downwardly from said vertical portion, said fixed contact vertical base portion being fixed in a said base fixed contact receiving slot, said extending portion overlying said track floor and having its upper surface generally parallel with the upper surface of said contact spacer portion, said vertical connector portion engaging said case contact retaining means, said paddle actuator having a tapered paddle extending exterior of said case frame for manual actuation of said switch, a downwardly extending generally flat projection having on its lower edge a spring positioner, a closure element generally convex outwardly of said switch, said actuator being pivotably fixed in said case, said roller contact being electrically conductive and having two roller elements and a guide track follower portion connecting said roller elements, said follower portion being of smaller cross section than said roller elements, said roller being positioned in said base track for movement therealong, said switch further including an insulating guide element having an upper neck portion and a lower roller engaging surface, and a compression spring secured between said actuator spring position and said guide neck, said guide lower surface engaging said roller element follower portion for movement of said roller element responsive to motion of said paddle, from an open circuit condition in which said roller contact is urged by said spring against said roller stop wall and said roller elements are spaced from said fixed contacts, an initial closed circuit condition in which each said roller element engages only a said fixed contact extending portion, and a steady-state closed circuit condition in which said roller contact is urged against said fixed contacts and said roller elements engage said vertical connector portions.

2. The switch of claim 1, the shortest distance from said fixed contact extending portion to the nearest said roller element, said switch being in its said open circuit condition, being at least 1.5 mm.

3. The switch of claim 1, the path from one said fixed contact extending portion, across a first said contact spacer upper surface, over said raised roller guide, across the other said contact spacer upper surface to the other said fixed contact extending portion, being at least about 3.0 mm.

4. A compact snap-action appliance switch with indicator light, comprising an insulating base, an insulating case adapted for assembly to said base, two fixed contacts carried in said base, three contact springs carried in said base, a light connected between two of said contact springs, a paddle actuator movable in said case, and a roller contact movable by said actuator, said insulating base having a generally vertical wall element extending upwardly from said base and defining a base roller contact track portion and a base contact spring retaining portion, said track portion having a roller stop wall generally parallel with said wall element side walls connecting said roller stop wall and said wall element a track floor bounded by said walls and said wall element and having a raised roller guide extending between said wall element and said roller stop wall, contact spacer portions on either side of said roller guide, each said spacer portion extending lengthwise generally parallel with said guide between said wall element and said roller stop wall, each said spacer portion extending widthwise from said roller guide toward the adjacent said side wall and having a narrower widthwise extension adjacent said wall element than adjustment said roller stop wall, the upper surface of a said spacer portion being intermediate in height between said track floor and said roller guide upper surface, said track floor, said roller guide upper surface, and said contact spacer portion upper surfaces being generally concave upwardly with respect to said base, said spring retaining portion having two inner walls parallel with each other and extending from said wall element away from said track portion, said inner walls defining three generally similar parallel contact spring areas, each of the outer two said contact spring areas having a wire aperture adjacent said wall element, extending entirely through said base, a fixed contact receiving slot tangent to said wire aperture and adjacent to said base track portion, and a contact spring receiving slot spaced from said wall element, the middle siad contact spring area having a contact spring receiving slot adjacent said wall element, and a wire aperture spaced therefrom, said insulating case having end walls generally parallel with said base roller stop wall, and side walls connecting said end walls, contact retaining means carried on the inner surfaces of said side walls, and positioned for cooperation with said base fixed contact receiving slots, wire stop means carried on the inner surfaces of said side walls and a said end wall, and positioned for cooperation with said base wire apertures, an upper frame connected to said case walls and removed from said base, actuator pivot support means and actuator stop surfaces adjacent said frame portion overlying said roller contact track portion, each said fixed contact having a vertical base portion, a vertical connector portion integral therewith and extending above said base portion, and a generally horizontal extending portion declined slightly downwardly from said vertical portions, said fixed contact vertical base portion being fixed in a said base fixed contact receiving slot, said extending portion overlying said track floor and having its upper surface generally parallel with the upper surface of said contact spacer portion, said vertical connector portion engaging said case contact retaining means, each said contact spring having a generally vertical base portion received in a said base contact spring receiving slot, and a generally horizontally extending spring portion having its free and overlying a said base wire aperture, said indicator lamp being connected between the said contact spring fixed in one said outer base contact spring area and the said contact spring fixed in the middle said base contact spring area, said paddle actuator having a tapered paddle extending exterior of said case frame for manual actuation of said switch, a downwardly extending generally flat projection carrying two pivot ears and having on its lower edge a spring positioner, a closure element generally convex outwardly of said switch and having actuator stop means, said actuator being pivotably fixed in said case with said pivot ears in said case actuator pivot support means, said actuator stop means being engageable with said case actuator stop surfaces to limit pivotal motion of said paddle actuator between two extreme positions, said roller contact being electrically conductive and having two roller elements and a guide track follower portion connecting said roller elements, said follower portion being of smaller cross section than said roller elements, said roller being positioned in said base track for movement therealong, said switch further including an insulating guide element having an upper neck portion and a lower roller engaging surface, and a compression spring secured between said actuator spring positioner and said guide neck, said guide lower surface engaging said roller element follower portion for movement of said roller element responsive to motion of said paddle, from an open circuit condition in which said roller contact is urged by said spring against said roller stop wall and said roller elements are spaced from said fixed contacts, an initial closed circuit condition in which each said roller element engages only a said fixed contact extending portion, and a steady-state closed circuit condition in which said roller contact is urged against said fixed contacts and said roller elements engage said vertical connector portions.

* * * * *